US010641572B1

(12) United States Patent
Perry et al.

(10) Patent No.: US 10,641,572 B1
(45) Date of Patent: May 5, 2020

(54) MICROWAVE IGNITION OF ENERGETIC MATERIAL HOUSED WITHIN A GUN

(71) Applicant: Triad National Security, LLC, Los Alamos, NM (US)

(72) Inventors: William Lee Perry, Los Alamos, NM (US); Amanda Lynn Duque, Los Alamos, NM (US)

(73) Assignee: Triad National Security, LLC, Los Alamos, NM (US)

( * ) Notice: Subject to any disclaimer, the term of this patent is extended or adjusted under 35 U.S.C. 154(b) by 0 days.

(21) Appl. No.: 15/491,314

(22) Filed: Apr. 19, 2017

Related U.S. Application Data

(60) Provisional application No. 62/324,846, filed on Apr. 19, 2016.

(51) Int. Cl.
*F41A 19/58* (2006.01)
*F42B 5/08* (2006.01)

(52) U.S. Cl.
CPC ..... *F41A 19/58* (2013.01); *F42B 5/08* (2013.01)

(58) Field of Classification Search
CPC ..... F41A 19/58; F41A 19/63; F42B 5/08
USPC ..... 102/200, 202, 205
See application file for complete search history.

(56) References Cited

U.S. PATENT DOCUMENTS 3,601,054 A * 8/1971 Christianson ..... F41A 19/63 102/200
5,146,044 A * 9/1992 Kurokawa ..... F41A 19/63 102/200
5,272,828 A * 12/1993 Petrick ..... F41A 9/61 42/50
6,152,039 A * 11/2000 Lee ..... F02K 9/95 102/200
6,591,753 B1 * 7/2003 Schmid ..... F42B 5/08 102/205
8,387,534 B1 * 3/2013 Imholt ..... F42B 1/00 102/200
9,097,503 B1 * 8/2015 Perry, III ..... F42B 3/113
9,829,297 B2 * 11/2017 Graswald ..... C06B 45/00
(Continued)

FOREIGN PATENT DOCUMENTS

FR 2702832 A1 * 9/1994 ..... F41A 19/63
RU 2348004 C2 * 2/2009
WO WO-2005043069 A1 * 5/2005 ..... F41A 19/63

OTHER PUBLICATIONS

English translation of RU 2348004-C2 (Year: 2009).*

*Primary Examiner* — James S Bergin
(74) *Attorney, Agent, or Firm* — LeonardPatel P.C.; Michael Aristo Leonard, II; Sheetal Suresh Patel

(57) ABSTRACT

The systems and methods for microwave ignition of energetic material housed within a gun (e.g., primers and/or propellants) allow for the use of insensitive energetic materials and/or insensitive gas-generating materials in place of sensitive energetic materials relied upon by mechanical ignition systems. In some embodiments, the use of insensitive energetic materials and/or insensitive gas-generating materials increase the safety and reliability of guns that would otherwise need to depend on sensitive energetic material required by mechanical or laser ignition mechanisms. Additionally, in some embodiments, the systems and methods provide greater versatility with respect to the variety of energetic materials that may be employed within guns.

20 Claims, 5 Drawing Sheets

(56) References Cited

U.S. PATENT DOCUMENTS

2014/0013982 A1* 1/2014 Meir ..... B01J 19/126
102/205

* cited by examiner

MICROWAVE IGNITION OF ENERGETIC MATERIAL HOUSED WITHIN A GUN

CROSS REFERENCE TO RELATED APPLICATION

This application claims the benefit of U.S. Provisional Application No. 62/324,846, filed Apr. 19, 2016, which is incorporated herein by reference in its entirety.

STATEMENT REGARDING FEDERAL RIGHTS

The present invention was made with government support under Contract No. DE-AC52-06NA25396 awarded by the U.S. Department of Energy. The government has certain rights in the present invention.

BACKGROUND

Many gun systems (e.g., medium or large caliber gun systems) use a mechanical ignition system in which a firing pin must physically strike each shell or cartridge to be fired. The force delivered by the firing pin initiates a chemical reaction within a primer. The primer emits heat that then ignites a propellant charge, the force generated from which propels a projectile from the shell or cartridge. Because such systems require numerous moveable parts and rely on physical contact, they are susceptible to rapid wear, mechanical failure, and performance deterioration over time. Moreover, because many mechanical ignition systems require the use of a specific primer or propellant, they offer limited economy and versatility during combat. The timing events required by mechanical firing mechanisms are also stringent. As a result, seemingly minor changes in material composition or identity can result in an improperly functioning gun. Notably, the primers and propellants used in many mechanical ignition systems are also sensitive and thus susceptible to accidental ignition due to unintended stimulation (e.g., shock or vibration).

In theory, medium and large caliber gun systems may also use a laser ignition system. In practice, however, such systems are often prohibitively expensive. Moreover, laser ignition systems rely on an optical viewing window through which a laser beam passes en route to a primer or propellant. The combination of heat, pressure, and propellant residue from the propellant chamber, along with the laser energy repeatedly passing through the window, can cause performance-degrading clouding, obscuration, and/or pitting of the viewing window over time. These changes can lead to line-of-sight problems and other issues that impede the effectiveness and reliability of laser ignition systems.

SUMMARY

Systems and methods for microwave ignition of energetic material housed within a gun (e.g., primers and/or propellants) are provided herein. In some embodiments, a microwave ignition system includes a microwave transporter adapted to transport microwave energy into a gun. The microwave transporter is operably coupled to a microwave coupler adapted to apply the microwave energy to an energetic material housed within the gun. The microwave coupler may be operably coupled to the energetic material either with or without direct physical contact. The materials, composition, dimensions, and/or geometries of the microwave transporter, the microwave coupler, and the energetic material may be configured to achieve impedance matching between an impedance of the microwave transporter, an impedance of the microwave coupler, and an impedance of the energetic material. The energetic material may be selected based on its electric permittivity and/or magnetic permeability to preferentially couple to the electric or magnetic field component of the microwave energy (e.g., via optimized impedance matching). The microwave ignition system may include a gas-generating material and either the energetic material, the gas-generating material, or both may be insensitive materials.

DETAILED DESCRIPTION

Figure 1:
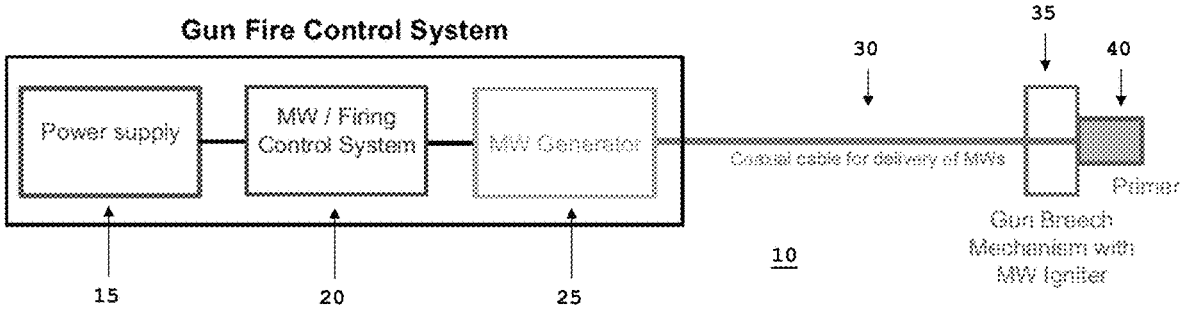
FIG. 1 is a block diagram illustrating a microwave ignition system according to some embodiments.

Systems and methods for microwave ignition of energetic material housed within a gun (e.g., primers and/or propellants) are provided herein by way of describing illustrative embodiments. As used herein, the term "gun" is intended to include guns, cannons, firearms and other devices that ignite an energetic material to propel a projectile. The embodiments are described for illustrative (i.e., explanatory) purposes only and do not constitute, nor should they be construed as, exhaustive or otherwise limited to the precise forms shown and described. Rather, additional embodiments and variations are possible as persons of ordinary skill in the art will readily recognize and appreciate in view of the following teaching. As used herein, the term "illustrative" means "presented only for the purpose of illustrating non-limiting examples" and is not intended to convey that any described subject matter is optimal, preferred, or otherwise more or less beneficial than any other described subject matter. As used herein, the articles "a" and "an" mean "at least one" or "one or more" unless otherwise stated.

In some embodiments, the systems and methods for microwave ignition of energetic material housed within a gun (e.g., primers and/or propellants) allow for the use of insensitive energetic materials and/or insensitive gas-generating materials in place of sensitive energetic materials relied upon by mechanical ignition systems. As used herein, the term "insensitive" describes a material whose chemical structure causes the material to resist igniting, exploding or combusting when subjected to unanticipated stimuli (e.g., unintended electromagnetic interference, vibration, shock, impact, flames, or structural damage). As persons of ordinary skill in the art will recognize and appreciate, in some embodiments the term "insensitive" may describe a material that meets the U.S. Department of Defense's Insensitive Munitions compliance standards. As used herein, the term "sensitive" means that a material whose chemical structure renders it capable of intentional ignition, explosion, or combustion by way of an ignition mechanism (e.g., a mechanical ignition system), but also renders it susceptible to unintended ignition, explosion, or combustion when subjected to unanticipated stimuli (e.g., unintended electromagnetic interference, vibration, shock, impact, flames, or structural damage). As persons of ordinary skill in the art will recognize and appreciate, in some embodiments the term "sensitive" may describe a material that fails to meet the U.S. Department of Defense's Insensitive Munitions compliance standards.

In some embodiments, the use of insensitive energetic materials and/or insensitive gas-generating materials increase the safety and reliability of guns that would otherwise need to depend on sensitive energetic material required by mechanical or laser ignition mechanisms. Additionally, in some embodiments, the systems and methods provide greater versatility with respect to the variety of energetic materials that may be employed within guns.

FIG. 1 is a block diagram illustrating a microwave ignition system 10 according to some embodiments. In some embodiments, as illustrated for example in FIG. 1, microwave ignition system 10 includes a power supply 15, a microwave control system or controller 20, a microwave generator 25, a microwave transporter 30 (e.g., a coaxial cable), a microwave coupler 35, and an energetic material 40 (e.g., a primer and/or propellant). Power supply 15, controller 20, and microwave generator 25 may function together as a firing control system.

Power supply 15 is operably coupled (e.g., electrically and/or communicatively coupled) to controller 20, which in turn is operably coupled to microwave generator 25. As used herein, the term "operably coupled" means coupled, whether directly (e.g., in direct physical contact) or indirectly (e.g., physically coupled through one or more intervening components or elements, or communicatively, electronically, or energetically coupled with or without any intervening physical components or elements) so as to permit the coupled components or elements to operate for their intended purpose.

Microwave generator 25 is operably coupled to microwave transporter 30, which in turn is operably coupled to microwave coupler 35. In some embodiments, microwave transporter 30 may be a coaxial cable (e.g., a power transmission line that meets the standards specified by the U.S. military's MIL-C-17 specifications or that otherwise fully contains microwave power), a waveguide, a stripline, a microstrip, a rectax, a slotline, a finline, or any other suitable device adapted to transport contained microwave energy from microwave generator 25 to microwave coupler 35. Microwave coupler 35 is operably coupled to energetic material 40 through a breech or breechblock of a gun (e.g., a medium or large caliber cannon or gun). In some embodiments, microwave coupler 35 may be operably coupled to energetic material 40 through a component of a gun other than a breech or breechblock (e.g., a cannon barrel, tube, or other suitable component). Microwave coupler 35 is adapted to receive microwave energy from microwave transporter 30 and apply the received microwave energy to energetic material 40. In some embodiments, microwave coupler 35 may be adapted to apply the microwave energy to energetic material 40 across a direct physical contact point. In some embodiments, microwave coupler 35 may be adapted to apply the microwave energy to energetic material 40 without physically contacting energetic material 40 (e.g., through a window or across an insulating gap).

In some embodiments, applying the microwave energy to energetic material 40 may include increasing, focusing, or concentrating the microwave energy. In some embodiments, applying the microwave energy to energetic material 40 may include applying the microwave energy to a focused or localized region of energetic material 40 (e.g., a localized ignition scheme that includes concentrating the microwave energy within a targeted region or locality of energetic material 40). In some embodiments, applying the microwave energy may include distributing the microwave energy throughout a substantial or entire portion of energetic material 40 (e.g., a volumetric ignition scheme) rather than focusing the microwave energy in a target region or locality. In some embodiments, energetic material 40 may be selected, configured, or adapted to increase, maximize, or make most efficient the transfer of the microwave energy either into a local region of energetic material 40 (as in the case of, for example, a localized ignition scheme) or throughout a substantial or entire volume of energetic material 40 (as in the case of, for example, a volumetric ignition scheme). In some embodiments, applying the microwave energy to energetic material 40 may include heating a partial or entire volume of air, gas, energetic material 40, or a combination thereof that is proximate to microwave coupler 35.

Energetic material 40 may include a primer, a propellant, or any suitable combination, mixture, or blend thereof. In some embodiments, energetic material 40 may include a plurality of energetic materials used together so as to increase, maximize, or optimize impedance matching between energetic material 40 and microwave coupler 35 and/or otherwise optimize the generation of a thermal runaway process that leads to ignition of energetic material 40. The composition, dimension, and geometry of each of the plurality of energetic materials may be adapted or configured to achieve impedance matching (e.g., by influencing a permittivity (dielectric constant) $\varepsilon_{EM}$ and/or a magnetic permeability $\mu_{EM}$ of each energetic material). In some embodiments, microwave ignition system 10 may ignite a primer, which may in turn ignite a propellant. In some embodiments, microwave ignition system 1*o* may directly ignite a propellant (e.g., a propellant bed), thus eliminating the need for a primer. In some embodiments, at least a portion of energetic material 40 may include insensitive material. In some embodiments, energetic material 40 may include insensitive material while excluding any sensitive material to reduce or mitigate the risk of unintended ignition presented by mechanical ignition systems.

The microwave energy required to ignite energetic material 40 may, in some embodiments, be initially generated from a short (e.g., less than one second) electromagnetic pulse. The frequency and power requirements of microwave ignition system 10 may be adapted to suit any gun in which the implementation of microwave ignition system 10 is desired. In some embodiments, the frequency may be tuned based on the size of a breech or other compartment of the gun. In some embodiments, the frequency may be from about 1 GHz to about 20 GHz. In some embodiments, the frequency may be from about 2 GHz to about to GHz. In some embodiments, the frequency may be from about 2 GHz to about 4 GHz. In some embodiments, the power may be from about 1 kW to about to kW. In some embodiments, the power may be from about 2 kW to about 8 kW. In some embodiments, the power may be from about 1 kW to about 4 kW.

In some embodiments, microwave coupler 35 may be operably coupled to energetic material 40 without directly contacting energetic material 40 (as illustrated, for example, in FIGS. 2A-2D). In some embodiments, microwave coupler 35 may be operably coupled to energetic material 40 so as to directly contact energetic material 40 (as illustrated, for example, in FIG. 3.). The composition, dimensions, and geometry of the various components of microwave ignition system 10 may be selected, configured, or adapted to achieve impedance matching between an impedance of the microwave transporter, an impedance of the microwave coupler, and an impedance of the energetic material.

Figure 2A:
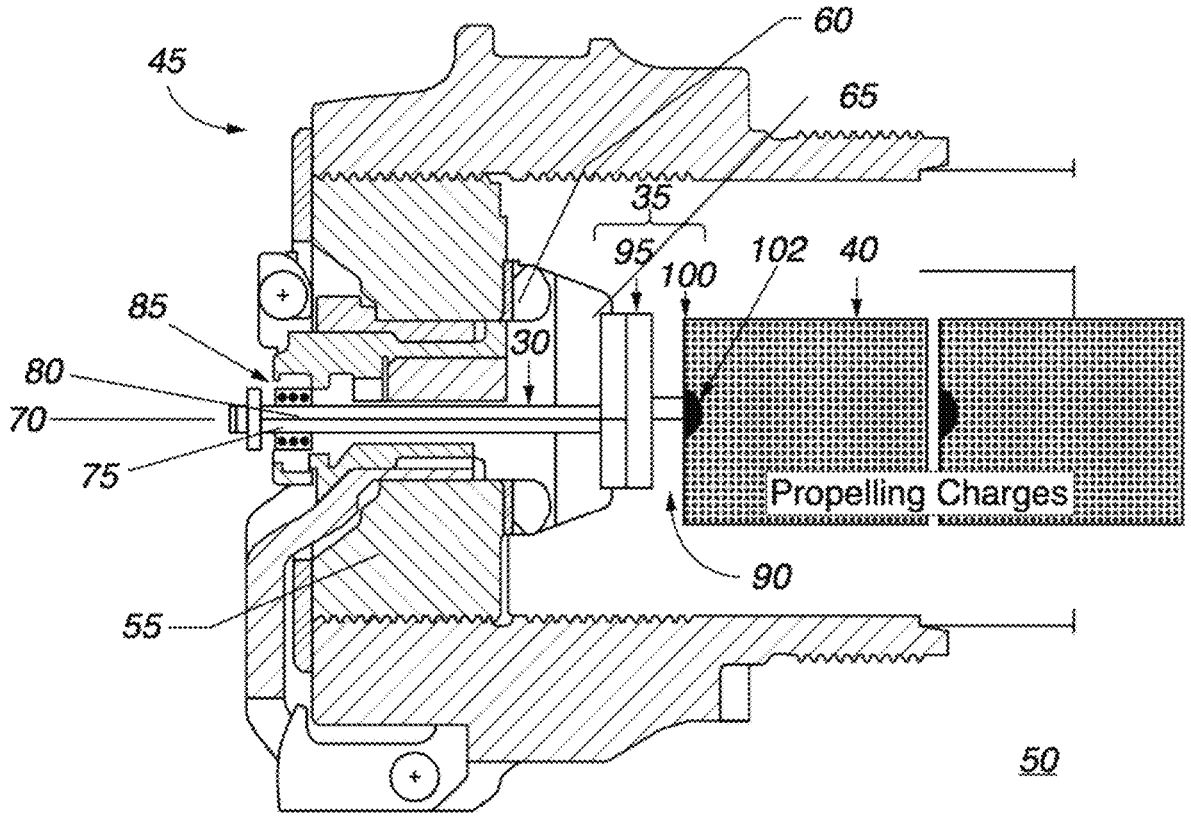
FIG. 2A is a longitudinal section of a breech of a gun equipped with a microwave ignition system according to some embodiments.

FIG. 2A is a longitudinal section of a breech 45 of a gun, cannon, or other gun 50 equipped with microwave ignition system 10 according to some embodiments. In some embodiments, as illustrated for example in FIG. 2A, breech 45 includes breech block assembly 55. Gun 50 is, in the example illustrated in FIG. 2A, a 155 mm M199 Howitzer™ cannon. In some embodiments, gun 50 may be any of various other types of guns, whether breech-loaded or non-breach-loaded, including for example any suitable medium or large caliber gun or cannon. In some embodiments, gun 50 may be a gun that uses cased propellant charges (e.g., a gun such as the 5-inch Mark 45™ U.S. naval artillery gun) rather than a gun that uses breech-loaded propellants (e.g., the 155 mm M199 Howitzer cannon).

Breech block assembly 55 includes, among other components illustrated in FIG. 2A, an inner ring 60 and a spindle 65. Microwave transporter 30 (e.g., a coaxial cable), which is operably coupled to microwave generator 25 as illustrated in FIG. 1, is extended into inner ring 60 and spindle 65 of breech block assembly 55. Microwave coupler 35 and energetic material 40 are arranged within gun 50 within or near breech 45. In some embodiments, microwave coupler 35 may be arranged entirely within an interior region of gun 50 (e.g., within breech block assembly 55). In some embodiments, microwave coupler 35 may be arranged only partially within an interior region of gun 50, while at least a portion of microwave coupler 35 may extend into or be arranged within an external region of gun 50 (e.g., mounted to an external surface of a barrel or other component at or near breech 45). In some embodiments, the internal components of gun 50, including breech block assembly 55, inner ring 60, and spindle 65, may be arranged in configurations other than the illustrative configuration shown in FIG. 2A. In some embodiments, for example, inner ring 60 and spindle 65 may be omitted and/or replaced with other components as dictated by the type of gun 50 in which microwave ignition system 10 is implemented.

In some embodiments, for example as illustrated in FIG. 2A, microwave transporter 30 includes a connector 70, a dielectric 75, and a conductor 80. Microwave transporter 30 may extend through an electrode 85 adapted to permit the flow of electricity. Microwave transporter 30 is operably coupled to microwave generator 25 by way of connector 70. In some embodiments, connector 70 may be a threaded port, a nonthreaded port, or any other suitable component adapted to operably couple microwave transporter 30 to microwave generator 25. Dielectric 75, which may include or be composed of high density polyethylene or another suitable material, is extended from connector 70 along a longitudinal axis of microwave transporter 30. Conductor 80 is extended along a longitudinal axis of dielectric 75.

Microwave transporter 30 is operably coupled to microwave coupler 35, which in turn is operably coupled to energetic material 40. In some embodiments, for example as illustrated in FIGS. 2A-2D, microwave coupler 35 is operably coupled to energetic material 40 without directly contacting energetic material 40. Energetic material 40 may include or be configured as one or more primers, one or more propellants, or any suitable combination, mixture, or blend thereof.

To transfer power (e.g., microwave energy) from microwave coupler 35 to energetic material 40 without directly contacting energetic material 40 (e.g., through a window or across an insulating gap 90), microwave coupler 35 includes a microwave transmitter or broadcaster 95 operably coupled to a microwave receiver 100. Microwave transporter 30 is operably coupled to microwave transmitter 95. To increase, focus, concentrate, maximize, or optimize the transfer of microwave energy between various components of microwave ignition system 10 (e.g., from microwave transporter 30 to microwave coupler 35), the materials, configurations, positions, dielectric constant, electric permittivity, and/or dimensions of such components may be selected to facilitate impedance matching. Microwave transporter 30 has, for example, an impedance $Z_{TP}$ (e.g., a predetermined impedance) and supplies power to microwave transmitter 95. As used herein, the use of a verb in the present tense (e.g., supplies, transfers, concentrates, or any other verb used in the present tense) describes an action or effect that occurs during operation as a result of the subject component or element being adapted, configured, or otherwise structurally and/or programmatically designed to perform or cause the action or effect. In some embodiments, impedance $Z_{TP}$ of microwave transporter 30 may be tuned or configured to match an impedance $Z_{TM}$ of microwave transmitter 95. As used herein, the term "match" does not require absolute identity or equality, but rather is intended to account for variations or margins of error considered immaterial by persons of ordinary skill in the art. In some embodiments, impedance $Z_{TP}$ of microwave transporter 30 may be tuned or configured by varying a shape of conductor 80.

Microwave transmitter 95 transfers power to receiver 100 (e.g., by broadcasting or otherwise transmitting microwave energy waves). Microwave transmitter 95 includes one or more dielectric layers and has a dielectric thickness, a dielectric constant, and a diameter. In some embodiments, impedance $Z_{TM}$ of microwave transmitter 95 may be tuned or configured to optimize (e.g., to increase, maximize, concentrate, or make most efficient) the power transferred from microwave transmitter 95 to receiver 100 by matching an impedance $Z_R$ of receiver 100. In some embodiments, impedance $Z_{TM}$ of microwave transmitter 95 may be tuned or configured by adjusting a value for each of the dielectric thickness, the dielectric constant, and the diameter of microwave transmitter 95 (e.g., by varying the dimensions, composition, and/or quantity of the dielectric layers). An impedance $Z_R$ of receiver 100 may be tuned or configured to match impedance $Z_{TM}$ of microwave transmitter 95 by varying a shape of receiver 100.

Receiver 100 is operably coupled to energetic material 40. To ignite energetic material 40, receiver 100 applies power to energetic material 40. Energetic material 40 may be selected based on its electric permittivity and/or magnetic permeability to preferentially couple to the electric or magnetic field component of the microwave energy (e.g., via optimized impedance matching). Applying power to energetic material 40 may heat energetic material 40 so as to cause a thermal runaway process that results in ignition. In some embodiments, for example as illustrated in FIG. 2A, microwave ignition system 10 may include a plurality of receivers too adapted or configured to ignite a plurality of charges of energetic material 40. Receivers too may ignite the plurality of charges of energetic material 40 either simultaneously or selectively in a sequence (e.g., a desirable or otherwise predetermined or variable-phase sequence, or a random sequence). As used herein, the term "simultaneously" does not require that the described actions or events occur at an identical point in time, but rather is intended to account for variations or margins of error considered immaterial by persons of ordinary skill in the art.

In some embodiments, applying power to energetic material 40 may include applying the microwave energy to a focused or localized region 102 of energetic material 40 (e.g., a localized ignition scheme that includes concentrating the microwave energy within a targeted region or locality of energetic material 40). In some embodiments, focused or localized region 102 of energetic material 40 may include a second energetic material (e.g., an ignition element) that may be distinct in composition, dimension, or geometry from the remainder of energetic material 40. The composition, dimensions, and geometry of the second energetic material of region 102 may be selected and/or adapted to achieve impedance matching between receiver 100 and energetic material 40. The second energetic material may increase, maximize, optimize, or make most efficient the generation of a thermal runaway process that results in ignition of energetic material 40.

In some embodiments, applying the power may include distributing the microwave energy throughout a substantial or entire portion of energetic material 40 (e.g., a volumetric ignition scheme) rather than focusing the microwave energy in a target region or locality. In some embodiments, energetic material 40 may be selected, configured, or adapted to increase, maximize, or make most efficient the transfer of the microwave energy either into a local region of energetic material 40 (as in the case of, for example, a localized ignition scheme) or throughout a substantial or entire volume of energetic material 40 (as in the case of, for example, a volumetric ignition scheme).

Figure 2B:
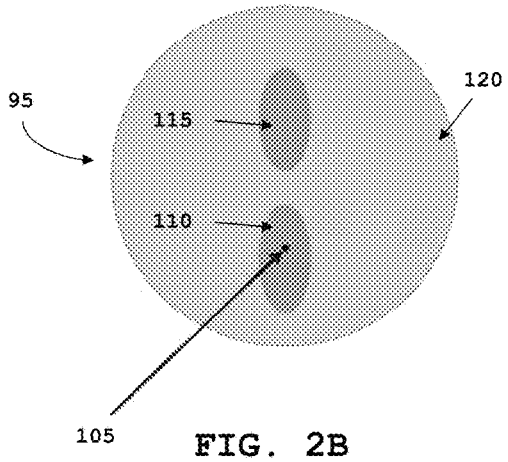
FIG. 2B is a cross-section of a microwave transmitter according to some embodiments.

FIG. 2B is a cross-section of microwave transmitter 95 according to some embodiments. In some embodiments, for example as illustrated in FIG. 2B, microwave transmitter 95 includes a power feed 105, an active radiating element 110, and a passive radiating element 115. Power feed 105 is adapted to supply power to active radiating element 110. Active radiating element 110 and passive radiating element 115 are sandwiched between a plurality of dielectric layers 120 of microwave transmitter 95. The dielectric layers 120 each have a diameter, a thickness, and permittivity $\varepsilon_L$. In some embodiments, microwave transmitter 95 may include one active radiating element 110 and one passive radiating element 115. In some embodiments, microwave transmitter 95 may include a plurality of active radiating elements no and/or a plurality of passive radiating elements 115. The power transferred from microwave transmitter 95 to receiver 100 may be optimized (e.g., increased, maximized, concentrated, or made most efficient) by varying a shape of active radiating element 110 and/or a shape of passive radiating element 115.

Figure 2D:
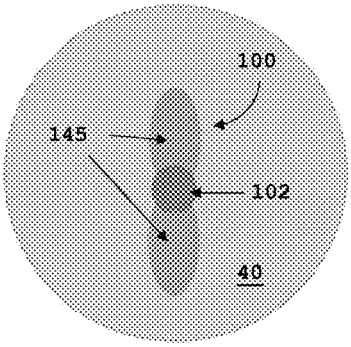
FIG. 2D is a cross-section of a microwave receiver according to some embodiments.
Figure 2C:
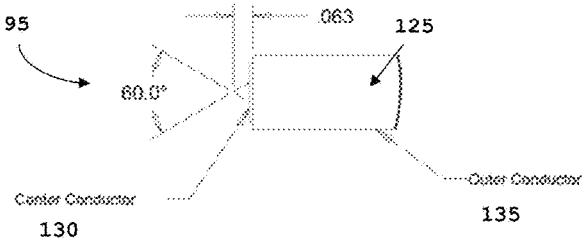
FIG. 2C is a side view of microwave transmitter according to some embodiments.

FIG. 2C is a side view of microwave transmitter 95 according to some embodiments. In some embodiments, microwave transmitter 95 includes an N-type connector or other connector to which microwave transporter 30 is operably coupled. Microwave transmitter 95 may include or be composed of semi-rigid RG401 coax cable or other suitable materials. As illustrated in FIG. 2C, microwave transmitter 95 includes an inner conductor 125, a center conductor 130, and an outer conductor 135. In some embodiments, inner conductor 125 may include a copper wire plated in silver (e.g., having a diameter of about 1.63 mm). The silver-plated copper wire may be surrounded by a polytetrafluoroethylene (PTFE) insulating layer (e.g., having a diameter of about 5.31 mm). In some embodiments, the wire may be surrounded by other suitable materials, such as a plastic, a plastic-based material, a ceramic material, or other materials characterized by a low dielectric loss. The PTFE insulating layer may be shielded by a copper sheath (e.g., having a diameter of about 6.35 mm). In some embodiments, the insulating layer may be shielded by other suitable materials, including aluminum, brass, silver, or other materials characterized by high conductivity. In some embodiments, the insulating layer may be shielded by stainless steel. As used herein, the term "about" means that the described value is not intended to be limited to the precise value stated, but rather is intended to account for variations or margins of error considered immaterial by persons of ordinary skill in the art.

Center conductor 130 protrudes from the PTFE insulating layer and copper sheath of inner conductor 125. In some embodiments, center conductor 130 may protrude at a predetermined length, angle, and/or geometric shape. In some embodiments, for example as illustrated in FIG. 2C, center conductor 130 protrudes in the shape of a cone having a length of about 0.06 inches and a vertex angle of about 60 degrees. The length and angle at which center conductor 130 protrudes, and the overall shape of center conductor 130, may be varied so as to tune, configure, or adapt center conductor 130 to deliver an electromagnetic field of a desired (e.g., predetermined) phase and/or strength. In some embodiments, the length and angle at which center conductor 130 protrudes, in addition to the overall configuration of microwave transmitter 95, may be different than the illustrative examples shown in FIG. 2C.

In some embodiments, microwave coupler 35 may omit receiver 100 and ignite energetic material 40 by heating energetic material 40 in the direct volume proximity of microwave coupler 35 (e.g., in the direct volume proximity of a region of microwave transmitter 35). Microwave coupler 35 may, for example, include a protrusion or tip adapted to increase, focus, or concentrate microwave energy in the direct volume proximity of microwave coupler 35. In some embodiments, the protrusion or tip may be center conductor 130 as illustrated in FIG. 2C.

FIG. 2D is a cross-section of receiver 100 according to some embodiments. In some embodiments, for example as illustrated in FIG. 2D, receiver 100 includes a plurality of receiver elements 145 adapted to receive power that is transmitted, broadcasted, or otherwise delivered by microwave transmitter 95. In some embodiments, receiver elements 145 apply the power received from microwave transmitter 95 onto energetic material 40. In some embodiments, receiver 100 may include at least one receiver element 145. In some embodiments, receiver 100 may include a plurality of receiver elements 145 (e.g., as illustrated in FIG. 2D).

In some embodiments, receiver 100 includes a thin dielectric patch operably coupled to energetic material 40 (e.g., one or more primer and/or propellant charges). In some embodiments, dielectric patch may include biaxially-oriented polyethylene terephthalate (e.g. Mylar™), a polyimide (e.g., Kapton™), or any suitable combination, mixture, or blend thereof. In some embodiments, dielectric patch may include or be composed of silicone, polyurethane, polytetrafluoroethylene (PTFE), high-density polyethylene (HDPE), polystyrene, one or more other suitable materials, or combinations thereof.

In some embodiments, the dielectric patch may have a thickness of less than about 7 millimeters. In some embodiments, the dielectric patch may have a thickness from about 0.3 millimeters to about 5 millimeters. In some embodiments, the dielectric patch may have a thickness of less than about 1 millimeter. In some embodiments, the dielectric patch may have a thickness from about 4 microns to about 50 microns. In some embodiments, the dielectric patch may have a thickness from about 4 microns to about 125 microns.

In some embodiments, applying the power to energetic material 40 may include increasing, focusing, or concentrating the power. In some embodiments, applying power to energetic material 40 may include applying the microwave energy to a focused or localized region 102 of energetic material 40 (e.g., a localized ignition scheme that includes concentrating the microwave energy within a targeted region or locality of energetic material 40). In some embodiments, applying the power may include distributing the microwave energy throughout a substantial or entire portion of energetic material 40 (e.g., a volumetric ignition scheme) rather than focusing the microwave energy in a target region or locality. In some embodiments, energetic material 40 may be selected, configured, or adapted to increase, maximize, or make most efficient the transfer of the microwave energy either into a local region of energetic material 40 (as in the case of, for example, a localized ignition scheme) or throughout a substantial or entire volume of energetic material 40 (as in the case of, for example, a volumetric ignition scheme).

Figure 2E:
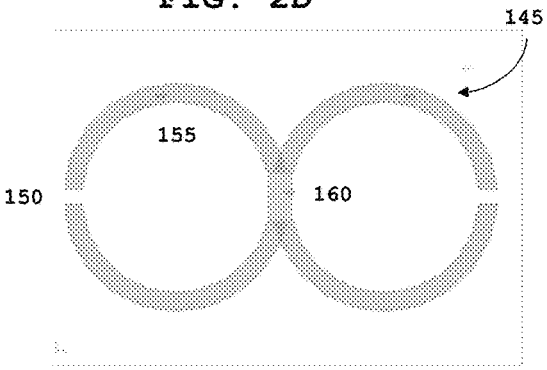
FIG. 2E is a cross-section of a microwave receiver element according to some embodiments.

FIG. 2E is a diagram illustrating receiver element 145 according to some embodiments. Receiver element 145 includes a capacitive element 150, an inductive element 155, and a resistive element 160. Capacitive element 150 may be operably coupled to inductive element 155, which may be operably coupled to resistive element 160. Capacitive element 150 may be operably coupled to resistive element 160. In some embodiments, the configuration in which capacitive element 150, inductive element 155, and resistive element 160 are coupled to one another may be different than the illustrative configuration shown in FIG. 2E. Capacitive element 150, inductive element 155, and resistive element 160 may be adapted to apply or concentrate power onto energetic material 40.

Energetic material 40 has a complex permittivity (dielectric constant) $\varepsilon_{EM}$ and a magnetic permeability $\mu_{EM}$. Complex permittivity $\varepsilon_{EM}$ is described by temperature-dependent real and imaginary components. The real component of complex permittivity $\varepsilon_{EM}$ is associated with an ability of energetic material 40 to store electric energy. The imaginary component of complex permittivity $\varepsilon_{EM}$ is associated with a dielectric loss (or energy dissipation) that occurs in energetic material 40. Magnetic permeability $\mu_{EM}$ may be described as the ability of matter to generate internal magnetic fields. The rate at which energetic material 40 may be efficiently heated and ignited may depend on the permittivity $\varepsilon_{EM}$ and a permeability $\mu_{EM}$ of energetic material 40.

Energetic material 40 having a high permittivity $\varepsilon_{EM}$ (e.g., having a relative dielectric loss of greater than about 0.1) may rapidly absorb power (e.g., electromagnetic energy) received from microwave coupler 35 and convert the power to heat. As used herein, references to dielectric constant refer to relative dielectric constant, the absolute value of which may be found by multiplying the constant by the permittivity or permeability of free space expressed respectively in, for example, units of farads per meter (F/m) or henries per meter (H/m). Energetic material 40 having a high magnetic permeability $\mu_{EM}$ (e.g., a relative permeability greater than about 5), may cause the electric or magnetic field component of the electromagnetic energy to preferentially couple to energetic material 40 and result in controlled or localized heating. As used herein, the term "preferentially" means that, if the electric or magnetic field component of the electromagnetic energy were presented with the option of coupling to either energetic material 40 or to something other than the energetic material 40, the electric or magnetic field component would couple to the energetic material 40. Thus, by configuring microwave ignition system 10 to include particular energetic material 40 and/or particularly tuned or configured microwave coupler 35, the electromagnetic field may in some embodiments be focused in a direct volume proximity of microwave coupler 35 (e.g., in the direct volume proximity of a tip region of microwave transmitter 95). Focusing the electromagnetic field may cause a hotspot formation that leads to a thermal runaway process. The thermally unstable hotspot may reach a threshold ignition temperature of energetic material 40 and initiate a self-propagating combustion process within an entire volume of energetic material 40. In some embodiments, energetic material 40 may have a relative permeability $\mu_{EM}$ from about 1 to about 10. In some embodiments, energetic material 40 may have a relative permeability $\mu_{EM}$ from about 3 to about 7. In some embodiments, energetic material 40 may have a relative permeability $\mu_{EM}$ of greater than about 5.

In some embodiments, microwave ignition system 10 may include a variety of energetic materials 40, some or all of which may have different permittivity $\varepsilon_{EM}$ and permeability $\mu_{EM}$ values. Thus, permittivity $\varepsilon_{EM}$ and/or permeability $\mu_{EM}$ may be selected or configured to suit a desired application (e.g., to achieve a desired firing timing or to optimize energy transfer). In some embodiments, energetic material 40 may include a plurality of energetic materials used together so as to increase, maximize, or optimize impedance matching between energetic material 40 and microwave coupler 35 and/or otherwise optimize the generation of a thermal runaway process that leads to ignition of energetic material 40. The composition, dimension, and geometry of each of the plurality of energetic materials may be adapted or configured to achieve impedance matching (e.g., by altering the permittivity $\varepsilon_{EM}$ and/or a permeability $\mu_{EM}$ of energetic material 40 so as to configure an impedance $Z_{EM}$ of energetic material 40, as persons of ordinary skill in the art will understand and appreciate).

In some embodiments, energetic material 40 may include a thermite material, such as aluminum/iron oxide ($Al/Fe_2O$), iron oxide ($Fe_3O_4$), cupric oxide (CuO), or any suitable combination, mixture, or blend thereof. In some embodiments, energetic material 40 may include octahydro-1,3,5,7-tetranitro-1,3,5,7-tetrazocine (octogen or HMX™), 1,3,5-trinitroperhydro-1,3,5-triazine (hexogen, cyclonite, or RDX™), or other explosive nitroamine materials. In some embodiments, energetic material 40 may include a combination, mixture, or blend of one or more of the foregoing materials or any other suitable energetic material (e.g., a material having a high magnetic component or permeability $\mu_{EM}$, such as a relative permeability greater than 5). In some embodiments, the thermite material may be insensitive. In some embodiments, energetic material 40 may be at least partially in powder form, at least partially in pellet form, at least partially in strand or extruded form, or at least partially in any other suitable form.

In some embodiments, energetic material 40 may include an insensitive energetic material, such as triaminotrinitrobenzene, 1,1-diamino-2,2-dinitroethene, PBX-9502, PBX-9503, DNAN, LX-17-0, PBXW-14, DAAF, NTO, LAX-112, or FOX-7. In some embodiments, energetic material 40 may include a combination, mixture, or blend of one or more of the foregoing materials or any other suitable energetic material (e.g., a material having a high magnetic component or permeability $\mu_{EM}$, such as a relative permeability greater than 5).

Energetic material 40 may be further characterized by a gas generation (e.g., pressure) value and ignition time value. In some embodiments, energetic material 40 have an ignition time value in a range of greater than 0 milliseconds and less than about 15 milliseconds. In some embodiments, energetic material 40 may have an ignition time in a range of greater than 0 milliseconds and less than about 10 milliseconds. In some embodiments, energetic material 40 may have an ignition in a range of greater than 0 milliseconds and less than about 8 milliseconds. In some embodiments, energetic material 40 may have an ignition in a range of greater than 0 milliseconds and less than about 6 milliseconds.

In some embodiments, microwave ignition system 10 may include a gas-generating material in addition to energetic material 40. The addition of the gas-generating material may increase a rate at which an initial ignition of energetic material 40 propagates (e.g., propagates through an entire volume of energetic material 40). In some embodiments, the gas-generating material may be insensitive. In some embodiments, the gas-generating material may include a mixture of at least 1,1-diamino-2,2-dinitro-ethylene and potassium nitrate. In some embodiments, the gas-generating material may include a first composition or mixture, which may include or consist essentially of 1,1-diamino-2,2-dinitro-ethylene (e.g., about 30 wt %), potassium nitrate (e.g., about 40 wt %), hydroxyl propyl cellulose (e.g., about 6.7 wt %), N-ethyl/methyl 2-nitrato ethyl nitramine (e.g., about 8.57 wt %), magnesium (e.g., about 7 wt %), ethyl centralite or 1,3-diethyl-1,3-diphenylurea (e.g., about 0.5 wt %), and a cycloctene-based rubber additive, such as Vestenamer™ 8012 sold by Evonik Industries AG (e.g., about 0.5 wt %). In some embodiments, the first composition or mixture may include or consist essentially of the foregoing components in concentrations other than those expressly described herein for illustrative purposes.

In some embodiments, the gas-generating material may include a mixture of at least 1,1-diamino-2,2-dinitro-ethylene, guanylurea dinitramide, and potassium nitrate. In some embodiments, gas-generating material may include a second composition or mixture, which may include or consist essentially of a mixture of 1,1-diamino-2,2-dinitro-ethylene (e.g., about 15 wt %), guanylurea dinitramide (e.g., about 15 wt %), potassium nitrate (e.g., about 40 wt %), hydroxyl propyl cellulose (e.g., about 6.7 wt %), cellulose acetate butyrate (e.g., about 6.57 wt %), N-ethyl/methyl 2-nitrato ethyl nitramine (e.g., about 8.57 wt %), magnesium (e.g., about 7 wt %), ethyl centralite or 1,3-diethyl-1,3-diphenylurea (e.g., about 0.5 wt %), and a cycloctene-based rubber additive, such as Vestenamer® 8012 sold by Evonik Industries AG (e.g., about 0.5 wt %). In some embodiments, the second composition or mixture may include or consist essentially of the foregoing components in concentrations other than those expressly described herein for illustrative purposes.

In some embodiments, the gas-generating material may include dihydroxylammonium 5,5'-bis-1H-tetrazolate (DHA-BT), one or more polymetic binders, and/or other high-nitrogen gas generating materials. In some embodiments, the gas-generating material may include a combination, mixture, or blend of the first composition and the second composition, either alone or in a combination, mixture, or blend with dihydroxylammonium 5,5'-bis-1H-tetrazolate (DHA-BT), one or more polymetic binders, or other gas-generating materials. In some embodiments, the gas-generating material may be at least partially in powdered form, at least partially in pellet form, at least partially in strand or extruded form, or at least partially in any other suitable form.

Figure 3:
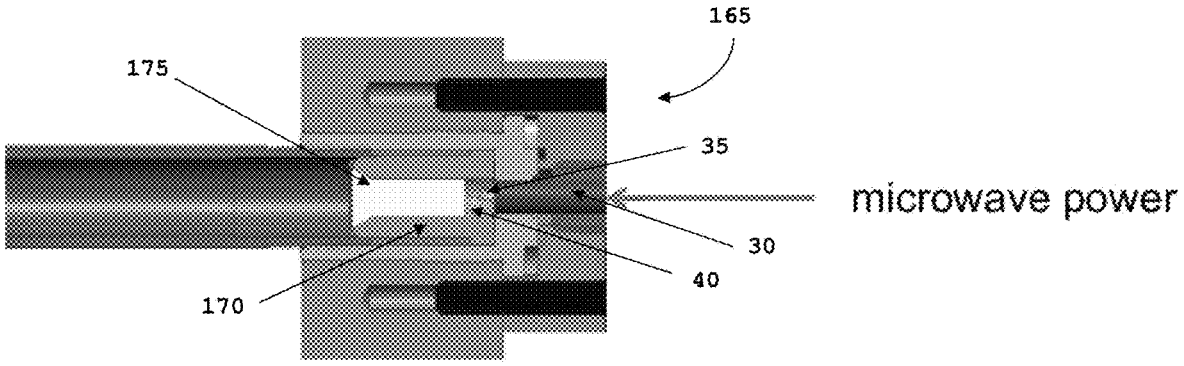
FIG. 3 is a longitudinal section of a primer tube and head stock assembly of a gun equipped with a microwave ignition system according to some embodiments.

FIG. 3 is a longitudinal section of a primer tube and head stock assembly 165 of a gun equipped with microwave ignition system 10 according to some embodiments. In some embodiment, for example as illustrated in FIG. 3, microwave coupler 35 is operably coupled to energetic material 40 such that microwave coupler 35 is in direct physical contact with energetic material 40. In some embodiments, microwave coupler 35 may ignite energetic material 40 by heating energetic material 40 in the direct volume proximity of microwave coupler 35 (e.g., in the direct volume proximity of a region of microwave coupler 35). Microwave coupler 35 may include a protrusion or tip adapted to increase, focus, or concentrate microwave energy in the direct volume proximity of microwave coupler 35. Microwave transporter 30 has an impedance $Z_{TP}$ (e.g., a predetermined impedance) and supplies power to microwave coupler 35. In some embodiments, impedance $Z_{TP}$ of microwave transporter 30 may be tuned or configured to match an impedance $Z_C$ of microwave coupler 35. Impedance $Z_C$ of microwave coupler 35 may be tuned or configured, for example by varying the materials and dimensions of microwave coupler 35, to match impedance $Z_{TP}$ of microwave transporter 30.

In some embodiments impedance $Z_{TP}$ of microwave transporter 30 and/or impedance $Z_C$ of microwave coupler 35 may each be about 50 ohms. In some embodiments, impedance $Z_{TP}$ of microwave transporter 30 and/or impedance $Z_C$ of microwave coupler 35 may each be from about 0.1 ohms to about 800 ohms. In some embodiments, impedance $Z_{TP}$ of microwave transporter 30 and/or impedance $Z_C$ of microwave coupler 35 may each be from about 1 ohm to about 500 ohms. In some embodiments, impedance $Z_{TP}$ of microwave transporter 30 and/or impedance $Z_C$ of microwave coupler 35 may each be from about to ohms to about 100 ohms. In some embodiments, impedance $Z_{TP}$ of microwave transporter 30 and/or impedance $Z_C$ of microwave coupler 35 may be other suitable impedance values outside the ranges described herein for illustrative purposes. As discussed herein, in some embodiments microwave coupler 35 may be operably coupled to energetic material 40 without being in direct physical contact with energetic material 40 (e.g., where microwave power is transmitted through a window or across an insulating gap).

Figure 4:
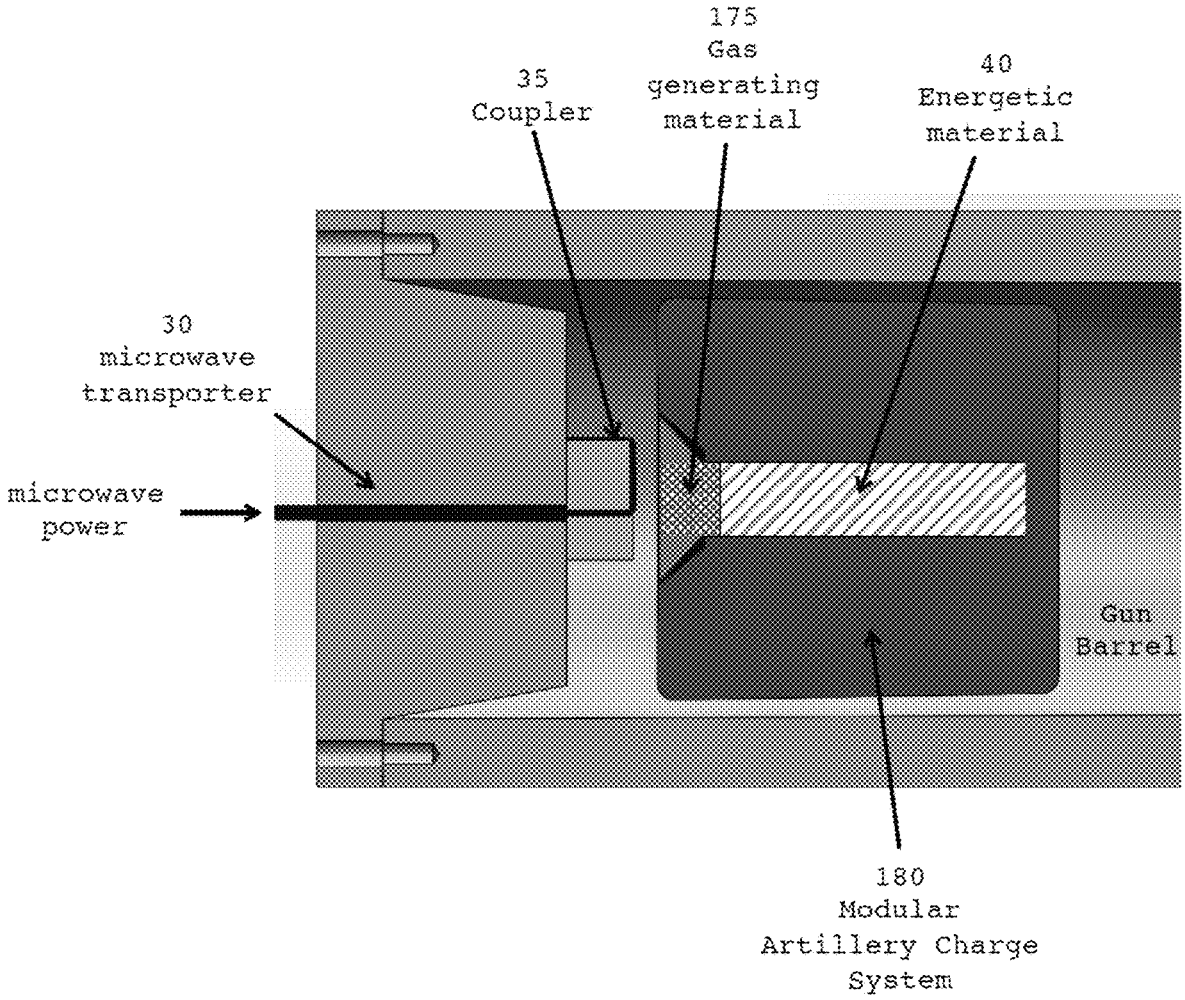
FIG. 4 is a cross-section of breech block of a 155 mm gun system equipped with a microwave ignition system according to some embodiments.

In some embodiments, for example as illustrated in FIG. 3, microwave ignition system 10 includes a booster cup 170 that houses energetic material 40 and/or a gas-generating material 175. In some embodiments, energetic material 40*o* and gas-generating material 175 may be positioned entirely within booster cup 17*o*. In some embodiments, energetic material 40 and gas-generating material 175 may be positioned partially within booster cup 170. In some embodiments, energetic material 40 may be blended with gas-generating material 175. In some embodiments, energetic material 40 may be aluminum/iron oxide ($Al/Fe_3O_4$) thermite and gas-generating material 175 may be the first composition. Energetic material 40 and gas-generating material 175 may be blended in a 50:50 ratio, for example. In other embodiments, the second composition may be used in combination with aluminum/iron oxide thermite. Depending on the desired firing timing, the gun in which microwave ignition system 10 is implemented, and the selection of energetic material 40 and gas-generating material 175, a variety of blend ratios may be employed. In some embodiments, for example as illustrated in FIG. 3, the blend of energetic material 40 and gas-generating material 175 is positioned in booster cup 170 behind an additional charge of gas-generating material 175. As used herein, the term "behind" means farther in distance from a muzzle end of a gun than a reference element or component (e.g., than the additional charge of gas-generating material 175 as used in the foregoing description). In some embodiments, gas-generating material 175 may be positioned within booster cup 145 (e.g., as illustrated in FIG. 4). In some embodiments, gas-generating material 175 may be positioned within components other than booster cup 170, such as directly within a primer tube of the gun equipped with microwave ignition system 10.

In some embodiments, for example as illustrated in FIG. 4, the ignitor of the microwave ignition system is not in direct contact with the energetic material. In some embodiments, the microwave energy is transmitted over a gap where the ignitor is not in physical contact with the energetic material 40. In some embodiments the energetic material 40 may be a modular artillery charge system (MACS) 180. In some embodiments the energetic material 40 is encased in the center of the projectile or MACS 180 and directed toward the microwave ignitor. In some embodiments the microwave coupler 35 is not in physical contact with the gas generating material 175 nor energetic material 40.

Although examples of possible energetic materials 40 and gas-generating materials 170 have been described herein, the examples have been provided for illustrative purposes only and are not intended to be, nor should they be construed as, a complete or limited list of materials that may be employed. In some embodiments, the use of insensitive energetic materials 40 and/or gas-generating materials 170 may significantly increase the safety and reliability of guns that otherwise depend on mechanical or laser ignition mechanisms. Additionally, the use of microwave ignition system 10 according to some embodiments may provide greater versatility with respect to selecting energetic material 40 (e.g., primer and/or propellant materials). The foregoing description has been presented for purposes of illustration. It is not intended to be exhaustive or to limit the subject matter to the precise forms disclosed. Persons of ordinary skill in the art will readily recognize and appreciate that modifications and variations are possible in light of, and suggested by, the above teaching. The described embodiments were chosen in order to best explain the principles of the subject matter, its practical application, and to enable others skilled in the art to make use of the same in various embodiments and with various modifications as best suited for the particular application being contemplated.

What is claimed is:

1. A gun, comprising:

a microwave control system comprising a power supply, a microwave control, and a microwave generator;

an energetic material disposed within a breech;

a microwave transporter coupled to the microwave control system; and a microwave coupler comprising a microwave transmitter and a microwave receiver, wherein the microwave transmitter is operably connected to the microwave receiver and the microwave transporter, and the microwave receiver is operably coupled to the energetic material and configured to apply power to ignite the energetic material.

2. The gun of claim 1, wherein the microwave generator produces power in a range between 1 and 10 kW.

3. The gun of claim 1, wherein the microwave generator produces power in a range between 1 and 4 kW.

4. The gun of claim 1, wherein the microwave generator operates at a frequency between 1 and 20 GHz.

5. The gun of claim 1, wherein the microwave generator operates at a frequency between 2 and 4 GHz.

6. The gun of claim 1, wherein the microwave generator produces power in a range between 1 and 4 kW and operates at a frequency of 2 and 4 GHz.

7. The gun of claim 1, wherein the energetic material comprises an insensitive explosive material.

8. The gun of claim 7, wherein the insensitive explosive material comprises FOX-7.

9. The gun of claim 8, wherein microwave energy sensitizes the insensitive explosive material.

10. The gun of claim 9, wherein the energetic material further comprises a thermite material.

11. The gun of claim 10, wherein the thermite material comprises aluminum/iron oxide ($Al/Fe_2O_3$).

12. The gun of claim 1, wherein the energetic material comprises an insensitive explosive material and a thermite material.

13. The gun of claim 12, wherein the insensitive explosive material comprises FOX-7 and the thermite material comprises aluminum/iron oxide ($Al/Fe_2O_3$).

14. The gun of claim 1, wherein the energetic material has a magnetic permeability between 1 and $10\mu_{EM}$.

15. The gun of claim 1, wherein the energetic material has a magnetic permeability between 3 and $7\mu_{EM}$.

16. The ignitor of claim 1 wherein the energetic material comprises a gas-generating material.

17. The ignitor of claim 16 where the gas-generating material comprises dihydroxylammonium 5,5'-bis-1H-tetrazolate (DHA-BT).

18. The ignitor of claim 16 where the energetic material comprises:

a gas-generating material comprised of 5'-bis-1H-tetrazolate (DHA-BT); and an insensitive explosive material comprised of FOX-7.

19. The ignitor of claim 18 further comprising a thermite material comprised of aluminum/iron oxide ($Al/Fe_2O_3$).

20. A gun, comprising:

a microwave control system comprising a power supply and a microwave generator;

a microwave transporter directly coupled to the microwave control system; and a microwave coupler comprising a microwave transmitter and a microwave receiver, the microwave transmitter operably connected to the microwave receiver and the microwave transporter, wherein the microwave coupler is configured to apply microwave energy to a focused or localized region of an energetic material, and the microwave transporter is located entirely within an interior region of the gun.

* * * * *